US010460665B2

(12) United States Patent
Wang et al.

(10) Patent No.: US 10,460,665 B2
(45) Date of Patent: Oct. 29, 2019

(54) OLED PIXEL DRIVING CIRCUIT AND DRIVING METHOD THEREOF

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Shan Wang, Guangdong (CN); Yichien Wen, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/741,824

(22) PCT Filed: Nov. 30, 2017

(86) PCT No.: PCT/CN2017/113717
§ 371 (c)(1),
(2) Date: Jan. 4, 2018

(87) PCT Pub. No.: WO2019/080256
PCT Pub. Date: May 2, 2019

(65) Prior Publication Data

US 2019/0122610 A1 Apr. 25, 2019

(30) Foreign Application Priority Data

Oct. 24, 2017 (CN) ..... 2017 1 1004261

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 3/3258
See application file for complete search history.

(56) References Cited

U.S. PATENT DOCUMENTS

2018/0033367 A1* 2/2018 Kim ..... G09G 3/3233
2018/0357961 A1* 12/2018 Yang ..... G09G 3/3258

FOREIGN PATENT DOCUMENTS

CN 104464624 3/2015
CN 104680982 6/2015
(Continued)

*Primary Examiner* — Nelson M Rosario
*Assistant Examiner* — Scott Au
(74) *Attorney, Agent, or Firm* — Hemisphere Law, PLLC; Zhigang Ma

(57) ABSTRACT

An OLED pixel driving circuit includes a first TFT, having a gate connected to a second node, and a source and a drain connected to a third node and a fourth node respectively; a second TFT, having a gate receiving a first signal, and a source and a drain connected to the second node and the fourth node respectively; a third TFT, having a gate receiving a second signal, and a source and a drain connected to a first node and the second node respectively; a fourth TFT, having a gate receiving a third signal, and a source and a drain connected to the fourth node and an anode of an OLED respectively; and a capacitor having two ends connected to the first node and the second node respectively. The third node is connected to a high voltage source and the first node is connected to a voltage input end.

4 Claims, 5 Drawing Sheets

(52) U.S. Cl.
CPC ..... *G09G 2300/0842* (2013.01); *G09G 2300/0861* (2013.01); *G09G 2320/0233* (2013.01); *G09G 2320/045* (2013.01)

(56) References Cited

FOREIGN PATENT DOCUMENTS

| | | |
|---|---|---|
| CN | 105702214 | 6/2016 |
| CN | 105789250 | 7/2016 |
| CN | 106782330 | 5/2017 |
| CN | 106920517 | 7/2017 |
| KR | 20110030210 | 3/2011 |

* cited by examiner

OLED PIXEL DRIVING CIRCUIT AND DRIVING METHOD THEREOF

RELATED APPLICATIONS

The present application is a National Phase of International Application Number PCT/CN2017/113717, filed on Nov. 30, 2017, and claims the priority of China Application Number 201711004261.0, filed on Oct. 24, 2017.

FIELD OF THE DISCLOSURE

The present invention is related to display technology, and more particularly is related to an OLED pixel driving circuit and a driving method thereof.

BACKGROUND

As a new generation display technology, organic light-emitting diode (OLED) panels have the advantages of low power consumption, high brightness, high resolution, wide viewing angle, high response speed, and etc., and thus are quite popular to the market.

Based on the driving methods, OLED displays can be sorted as the passive matrix OLED (PMOLED) display and the active matrix OLED (AMOLED) display. The AMOLED display features the active driving part to drive the pixels arranged in a matrix, has the advantage of high illumination efficiency, and thus is usually used as a large-scale display with high resolution.

FIG. 1 is a circuit diagram of a conventional OLED 2TIC pixel driving circuit. As shown, the technology of the conventional driving method and the pixel structure thereof is to apply different DC driving voltages to the OLED to have the OLED generates the needed color and brightness in different grayscales. 2T1C refers to the usage of two transistors and one capacitor, wherein the transistor T2 is the switching TFT, which is controlled by a scan signal Gate, and is utilized for controlling the entry of a data signal Data and acts as a switch to control charge/discharge of the capacitor Cst. The other transistor T1 is the driving TFT, which is utilized for driving the OLED by controlling the current passing through the OLED. The capacitor Cst is mainly utilized for storing the data signal Data so as to control the driving current applied to the OLED through the transistor T1. As an example, in the circuit diagram shown in FIG. 1, both the TFTs T1 and T2 are P-type TFTs, the scan signal Gate may come from a gate driver corresponding to a specific scan line, and the data signal Data may come from a source driver corresponding to a specific data line. OVDD is a high voltage power source, and OVSS is a low voltage power source.

After the scan signal Gate turns on the switch, the voltage Vdata of the data signal Data would be applied to the driving TFT T1 and stored in the capacitor Cst to have the transistor T1 stays in the on-state. Thus, the OLED would be continuingly placed in the DC-biased state and the internal ions would be polarized to form the internal electric field, which may result in the increasing of threshold voltage of the OLED and the brightness of the OLED would be steadily declined. The continuingly illumination would reduce the lifespan of the OLED. In addition, different degradation of the OLED pixels would result in display non-uniformity which may affect the display quality.

FIG. 2*a* is a circuit diagram of a conventional OLED 6TIC pixel driving circuit. FIG. 2*b* is a timing diagram of the circuitry shown in FIG. 2*a*. As shown, the circuit includes six thin-film transistors T1~T6 and one capacitor C1, wherein the TFT T6 is an N-type TFT. According to the timing diagram, the driving process of the OLED is controlled by the signals S1~S3 and divided into three stages t1~t3. However, the conventional OLED 6T1C pixel driving circuit has the following drawbacks: the pixel structure uses both the N-type TFT and the P-type TFT such that the fabrication process would be more complicated; the effective illumination area is smaller due to the 6T1C structure.

In conclusion, each of the aforementioned conventional OLED pixel driving circuits has the drawbacks need to be resolved. As shown in FIG. 1, the driving method of the conventional OLED 2T1C pixel driving circuit may result in degradation of OLED easily because the voltage Vdata would be stored in the capacitor Cst to have the driving TFT stays in the on-state after the scan signal Gate turns on the pixel driving circuit so as to have the OLED continuingly placed in the DC-biased state. As shown in FIG. 2*a* and FIG. 2*b*, the conventional OLED 6T1C pixel driving circuit uses more TFTs and these TFTs are of different conductive types such that the fabrication process would be more complicated.

SUMMARY

Accordingly, it is an object of the present invention to provide an OLED pixel driving circuit to eliminate the condition of illumination non-uniformity due to the variation of threshold voltage resulted from the non-uniformity of the fabrication process of the driving transistors.

It is another object of the present invention to provide a driving method of an OLED pixel driving circuit to eliminate the condition of illumination non-uniformity due to the variation of threshold voltage resulted from the non-uniformity of the fabrication process of the driving transistors.

In order to achieve the aforementioned objects, an OLED pixel driving circuit is provided in the present invention. The OLED pixel driving circuit includes a first thin film transistor (TFT), having a gate electrode thereof connected to a second node, and having a source electrode and a drain electrode thereof connected to a third node and a fourth node respectively; a second TFT, having a gate electrode thereof receiving a first signal, and having a source electrode and a drain electrode thereof connected to the second node and the fourth node respectively; a third TFT, having a gate electrode thereof receiving a second signal, and having a source electrode and a drain electrode thereof connected to a first node and the second node respectively; a fourth TFT, having a gate electrode receiving a third signal, and having a source electrode and a drain electrode thereof connected to the fourth node and an anode of an OLED respectively, and the OLED having a cathode connected to a low voltage power source; and a capacitor, having two ends thereof connected to the first node and the second node respectively; wherein the third node is connected to a high voltage power source; wherein the first node is connected to a voltage input end for inputting a data voltage or a reference voltage; wherein the first TFT, the second TFT, the third TFT, and the fourth TFT are P-type transistors.

In accordance with an embodiment of the OLED pixel driving circuit, a timing arrangement of the first signal, the second signal, and the third signal includes a data voltage storing stage, a threshold voltage compensation stage, and an illumination stage.

In accordance with an embodiment of the OLED pixel driving circuit, during the data voltage storing stage and the threshold voltage compensation stage, the voltage input end inputs the data voltage.

In accordance with an embodiment of the OLED pixel driving circuit, during the illumination stage, the voltage input end inputs the reference voltage.

In accordance with an embodiment of the OLED pixel driving circuit, during the data voltage storing stage, the first signal is at a high level, the second signal is at a low level, and the third signal is at a high level.

In accordance with an embodiment of the OLED pixel driving circuit, during the threshold compensation stage, the first signal is at a low level, the second signal is at a high level, and the third signal is at a high level.

In accordance with an embodiment of the OLED pixel driving circuit, during the illumination stage, the first signal is at a high level, the second signal is at a high level, and the third signal is at a low level.

A driving method for the aforementioned OLED pixel driving circuit is also provided in the present invention. The driving method comprises the step of arranging a timing of the first signal, the second signal, and the third signal to include a data voltage storing stage, a threshold voltage compensation stage, and an illumination stage.

In accordance with an embodiment of the driving method, during the data voltage storing stage and the threshold voltage compensation stage, the voltage input end inputs the data voltage.

In accordance with an embodiment of the driving method, during the illumination stage, the voltage input end inputs the reference voltage.

Another OLED pixel driving is also provided in the present invention. The OLED pixel driving circuit includes a first TFT, having a gate electrode thereof connected to a second node, and having a source electrode and a drain electrode thereof connected to a third node and a fourth node respectively; a second TFT, having a gate electrode thereof receiving a first signal, and having a source electrode and a drain electrode thereof connected to the second node and the fourth node respectively; a third TFT, having a gate electrode thereof receiving a second signal, and having a source electrode and a drain electrode thereof connected to a first node and the second node respectively; a fourth TFT, having a gate electrode receiving a third signal, and having a source electrode and a drain electrode thereof connected to the fourth node and an anode of an OLED respectively, and the OLED having a cathode connected to a low voltage power source; and a capacitor, having two ends thereof connected to the first node and the second node respectively; wherein the third node is connected to a high voltage power source; wherein the first node is connected to a voltage input end for inputting a data voltage or a reference voltage; wherein the first TFT, the second TFT, the third TFT, and the fourth TFT are P-type transistors; wherein a timing arrangement of the first signal, the second signal, and the third signal includes a data voltage storing stage, a threshold voltage compensation stage, and an illumination stage; wherein during the data voltage storing stage and the threshold voltage compensation stage, the voltage input end inputs the data voltage; wherein during the illumination stage, the voltage input end inputs the reference voltage; wherein during the data voltage storing stage, the first signal is at a high level, the second signal is at a low level, and the third signal is at a high level.

In conclusion, the OLED pixel driving circuit and the driving method thereof provided in accordance with the present invention eliminate the condition of illumination non-uniformity due to the variation of threshold voltage resulted from the non-uniformity of the fabrication process of the driving transistors such that the display quality of the panel can be enhanced; in addition, the fabrication process can be simplified by using the TFTs of the same type.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
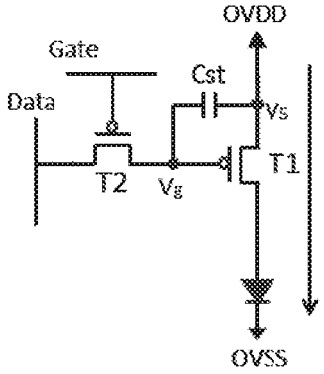
FIG. 1 is a circuit diagram of a conventional OLED 2T1C pixel driving circuit.
Figure 2A:
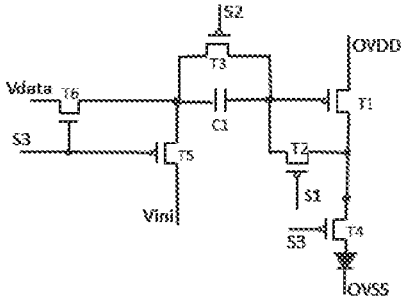
FIG. 2*a* is a circuit diagram of a conventional OLED 6T1C pixel driving circuit.
Figure 2B:
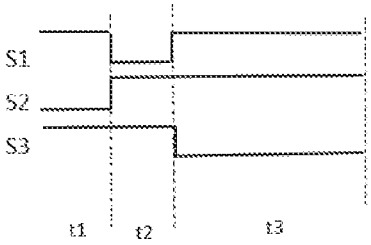
FIG. 2*b* is a timing diagram of the circuitry shown in FIG. 2*a;*
Figure 3:
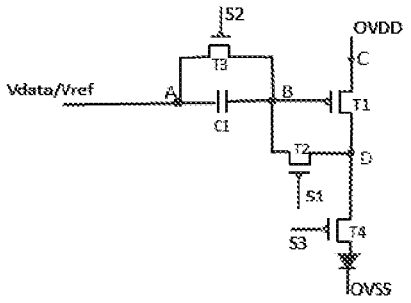
FIG. 3 is a circuit diagram of the OLED pixel driving circuit in accordance with a preferred embodiment of the present invention.
Figure 4:
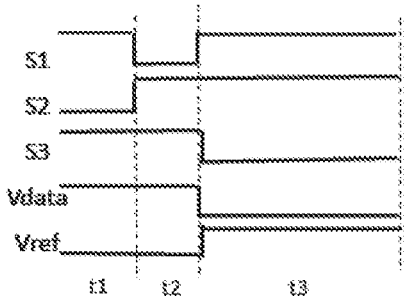
FIG. 4 is a timing diagram of the circuitry shown in FIG. 3.

Please refer to FIG. 3, which is a circuit diagram of the OLED pixel driving circuit in accordance with a preferred embodiment of the present invention, and FIG. 4 is a timing diagram of the circuitry of FIG. 3. As shown, an OLED 4T1C pixel driving circuit and a driving method thereof, utilized for driving the OLED is provided in the present invention. In accordance with the preferred embodiment, the circuit mainly includes: A thin film transistor (TFT) T1, having a gate electrode thereof connected to node B, and having a source electrode and a drain electrode thereof connected to node C and node D respectively; a TFT T2, having a gate electrode thereof receiving a signal S1, and having a source electrode and a drain electrode thereof connected to node B and node D respectively; a TFT T3, having a gate electrode thereof receiving a signal S2, and having a source electrode and a drain electrode thereof connected to node A and node B respectively; a TFT T4, having a gate electrode receiving a signal S3, and having a source electrode and a drain electrode thereof connected to node D and an anode of the OLED respectively, and the OLED having a cathode connected to a low voltage power source OVSS; and a capacitor C1, having two ends thereof connected to node A and node B respectively; wherein node C is connected to a high voltage power source OVDD; wherein node A is connected to a voltage input end Vdata/Vref for inputting a data voltage Vdata or a reference voltage Vref.

In the preferred embodiment, the TFTs T1, T2, T3, and T4 are P-type transistors.

The timing arrangement of the signal S1, the signal S2, and the signal S3 includes the data voltage storing stage, the threshold voltage compensation stage and the illumination stage, which corresponding to the three stages within the driving process, which are the first stage, i.e. the OLED data voltage Vdata storing stage, the second stage, i.e. the OLED threshold voltage compensation stage, and the third stage, i.e. the OLED illumination stage.

During the data voltage storing stage and the threshold voltage compensation stage, the input end Vdata/Vref inputs the data voltage Vdata. In accordance with the present preferred embodiment, the data voltage Vdata at this time is at a high level. During the illumination stage, the input end Vdata/Vref inputs the reference voltage Vref. In accordance with the present preferred embodiment, the reference voltage Vref at this time is at a high level.

Figure 5A:
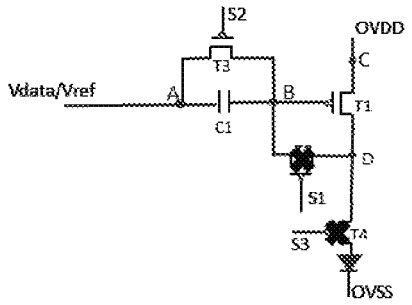
FIG. 5*a* is a schematic view showing the condition of the circuitry of FIG. 3 during the data voltage storing stage.
Figure 5B:
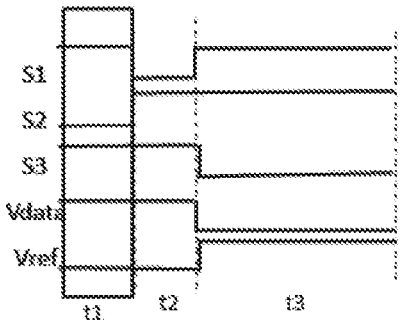
FIG. 5*b* is a timing diagram showing the circuit driving signals of the circuitry of FIG. 3 during the data voltage storing stage.

Please refer to FIG. 5*a* and FIG. 5*b*, wherein FIG. 5*a* is a schematic view showing the condition of the circuitry of FIG. 3 during the data voltage storing stage and FIG. 5*b* is a timing diagram of the corresponding circuit driving signals.

In the first stage, i.e. the OLED data voltage Vdata storing stage, the signal S1 is at a high level, the signal S2 is at a low level, and the signal S3 is at a high level.

Because the transistors in the circuit are P-type transistors, when the signal S2 is at the low level, the transistor T3 would be conducted, when the signals S1 and S3 are at the high level, the transistors T2 and T4 would be turned off, and the voltage level VA at node A equals to the voltage level VB at node B, which also equals to the data voltage Vdata.

The storing process of the OLED data voltage Vdata is completed in this stage.

Figure 6A:
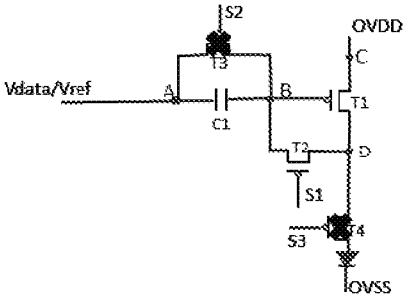
FIG. 6*a* is a schematic view showing the condition of the circuitry of FIG. 3 during the threshold voltage compensation stage.
Figure 6B:
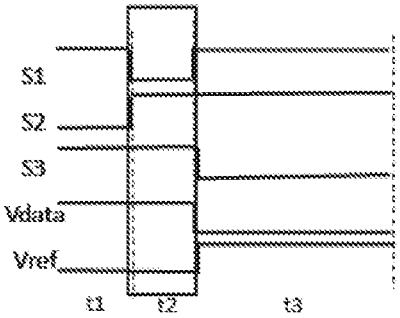
FIG. 6*b* is a timing diagram showing the circuit driving signals of the circuitry of FIG. 3 during the threshold voltage compensation stage.

Please refer to FIG. 6*a* and FIG. 6*b*, wherein FIG. 6*a* is a schematic view showing the condition of the circuitry of FIG. 3 during the threshold voltage compensation stage and FIG. 6*b* is a timing diagram of the corresponding circuit driving signals.

In the second stage, i.e. the OLED threshold voltage compensation stage, the signal S11 is at a low level, the signal S2 is at a high level, and the signal S3 is at a high level.

Because the signal S2 is at the high level, the TFT T3 would be turned off, because the signal S1 is at the low level, the TFT T2 would be conducted, and because of the effect of the capacitor C1, the node C would supply the electric power, and the TFT T1 would be conducted until reaching the cutoff voltage, i.e. VB=OVDD−Vth, VA=Vdata, wherein Vth represents the cutoff voltage of TFT T1.

The compensation of the OLED threshold voltage is completed in this stage.

Figure 7A:
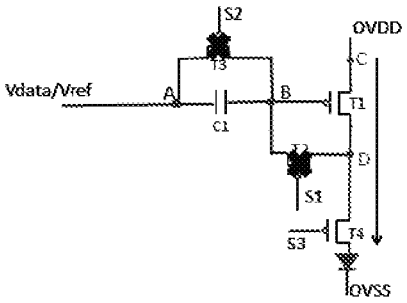
FIG. 7*a* is a schematic view showing the condition of the circuitry of FIG. 3 during the illumination stage.
Figure 7B:
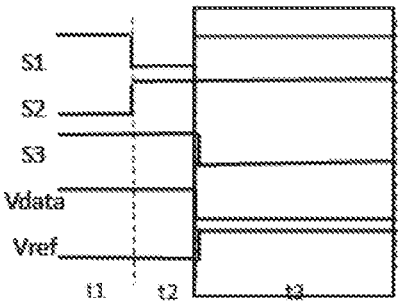
FIG. 7*b* is a timing diagram showing the circuit driving signals of the circuitry of FIG. 3 during the illumination stage.

Please refer to FIG. 7*a* and FIG. 7*b*, wherein FIG. 7*a* is a schematic view showing the condition of the circuitry of FIG. 3 during the illumination stage and FIG. 7*b* is a timing diagram of the corresponding circuit driving signals.

In the third stage, i.e. the OLED illumination stage, the signal S1 is at a high level, the signal S2 is at a high level, and the signal S3 is at a low level.

When the signal S3 is at the low level, the TFT T4 would be conducted. The voltage level at the node A is suddenly changed to the reference voltage Vref, and the change value is ΔV=Vref-Vdata. Because of the coupling effect of the capacitor C1, the voltage level at node B would be changed accordingly, i.e. from the original voltage level OVDD−Vth to the voltage level OVDD−Vth+ΔV, wherein OVDD−Vth+ΔV=OVDD−Vth+Vref-Vdata. In addition, because the TFT T1 is a P-type transistor, the driving current Ioled is represented as $Ioled=k(Vsg-Vth)^2=k(OVDD-OVDD+Vth-Vref+Vdata-Vth)^2=k(Vdata-Vref)^2$, and thus the condition of illumination non-uniformity due to the variation of threshold voltage resulted from the non-uniformity of the fabrication process of the driving transistors can be eliminated so as to have the OLED illuminates.

The illumination of the OLED is completed in this stage.

The driving method of the aforementioned pixel driving circuit is also provided in the present invention, which is capable to eliminate the condition of illumination non-uniformity due to the variation of threshold voltage resulted from the non-uniformity of the fabrication process of the driving transistors such that the display quality of the panel can be enhanced.

In conclusion, the OLED pixel driving circuit and the driving method thereof provided in accordance with the present invention eliminate the condition of illumination non-uniformity due to the variation of threshold voltage resulted from the non-uniformity of the fabrication process of the driving transistors such that the display quality of the panel can be enhanced; in addition, the fabrication process can be simplified by using the TFTs of the same type.

The foregoing contents are detailed description of the disclosure in conjunction with specific preferred embodiments and concrete embodiments of the disclosure are not limited to the description. For the person skilled in the art of the disclosure, without departing from the concept of the disclosure, simple deductions or substitutions can be made and should be included in the protection scope of the application.

What is claimed is:

1. An OLED pixel driving circuit, comprising:

a first thin film transistor (TFT), having a gate electrode thereof connected to a second node, and having a source electrode and a drain electrode thereof connected to a third node and a fourth node respectively;

a second TFT, having a gate electrode thereof receiving a first signal, and having a source electrode and a drain electrode thereof connected to the second node and the fourth node respectively;

a third TFT, having a gate electrode thereof receiving a second signal, and having a source electrode and a drain electrode thereof connected to a first node and the second node respectively;

a fourth TFT, having a gate electrode receiving a third signal, and having a source electrode and a drain electrode thereof connected to the fourth node and an anode of an OLED respectively, and the OLED having a cathode connected to a low voltage power source; and a capacitor, having two ends thereof connected to the first node and the second node respectively;

wherein the third node is connected to a high voltage power source;

wherein the first node is connected to a voltage input end for inputting a data voltage or a reference voltage;

wherein the first TFT, the second TFT, the third TFT, and the fourth TFT are P-type transistors;

wherein a timing arrangement of the first signal, the second signal, and the third signal includes a data voltage storing stage, a threshold voltage compensation stage and an illumination stage, the data voltage storing stage is immediately followed by the threshold voltage compensation stage, and the threshold voltage compensation stage is immediately followed by the illumination stage, the voltage input end inputs the data voltage during the data voltage storing stage and the threshold voltage compensation stage, the voltage input end inputs the reference voltage during the illumination stage, and the data voltage is used to determine a current flow through the OLED.

2. The OLED pixel driving circuit of claim 1 wherein during the data voltage storing stage, the first signal is at a high level, the second signal is at a low level, and the third signal is at a high level.

3. The OLED pixel driving circuit of claim 1 wherein during the threshold compensation stage, the first signal is at a low level, the second signal is at a high level, and the third signal is at a high level.

4. The OLED pixel driving circuit of claim 1 wherein during the illumination stage, the first signal is at a high level, the second signal is at a high level, and the third signal is at a low level.

* * * * *